US005186462A

United States Patent [19]

Biagi et al.

[11] Patent Number: 5,186,462

[45] Date of Patent: Feb. 16, 1993

[54] OSCILLATING BALL CANNON

[75] Inventors: Carl Biagi, Chicago; Steve Ritchie, Evanston; Dwight Sullivan, WoodDale, all of Ill.

[73] Assignee: Williams Electronics Games, Inc., Chicago, Ill.

[21] Appl. No.: 841,403

[22] Filed: Feb. 25, 1992

[51] Int. Cl.[5] ..... A63B 71/04

[52] U.S. Cl. ..... 273/129 S; 273/129 V

[58] Field of Search ..... 273/129 R, 129 S, 129 T, 273/129 V, 129 W

[56] References Cited

U.S. PATENT DOCUMENTS 4,437,664 3/1984 Wiczer et al. ..... 273/129 V X
4,438,928 3/1984 Wiczer ..... 273/129 V X
4,487,416 12/1984 Peters ..... 273/129 S X

*Primary Examiner*—Millin V.
*Assistant Examiner*—Raleigh W. Chiu
*Attorney, Agent, or Firm*—Rockey, Rifkin and Ryther

[57] ABSTRACT

The play feature of the invention consists of a ball projecting mechanism mounted for rotary motion about an axis disposed substantially perpendicular to the playfield. When a ball enters the projecting mechanism, a motor is activated which rotates the projecting mechanism about the axis. The player, by pressing a button, can control when the projecting means is fired thereby to control the direction of travel of the ball. A series of play features can be located at a position on the playfield spaced from the projecting mechanism to provide targets for the player.

13 Claims, 3 Drawing Sheets

OSCILLATING BALL CANNON

BACKGROUND OF THE INVENTION

The invention relates, generally, to pinball games and, more particularly, to an improved play feature for such games.

Pinball games, as commonly known, consist of an inclined playfield and a plurality of play features arranged on the playfield. A player uses flippers to direct a pinball at playfield features such as drop targets, gates, bumpers and the like to score points. As will be apparent, the more varied the playfield features offered by a manufacturer the greater the player appeal and interest. Therefore, the development of novel playfield features is necessary to attract the greatest number of players to a particular pinball game. Moreover, the more player interactive the play feature the greater the player appeal. Thus a new player interactive play feature is desired.

SUMMARY OF THE INVENTION

The play feature of the invention consists of a ball projecting mechanism mounted for rotary motion about an axis disposed substantially perpendicular to the playfield. When a ball enters the projecting mechanism, a motor is activated which rotates the projecting mechanism about the axis. The player, by pressing a button, can control when the projecting means is fired thereby to control the direction of travel of the ball. A series of play features can be located at a position on the playfield spaced from the projecting mechanism to provide targets for the player.

DETAILED DESCRIPTION OF THE INVENTION

Figure 2:
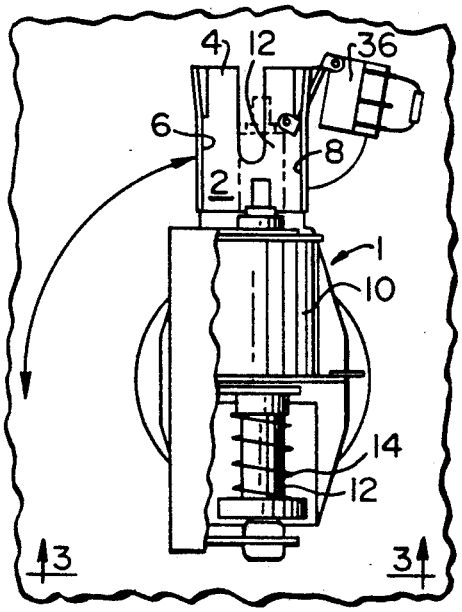
FIG. 2 is a partial cut-away top view of the play feature of the invention.
Figure 5:
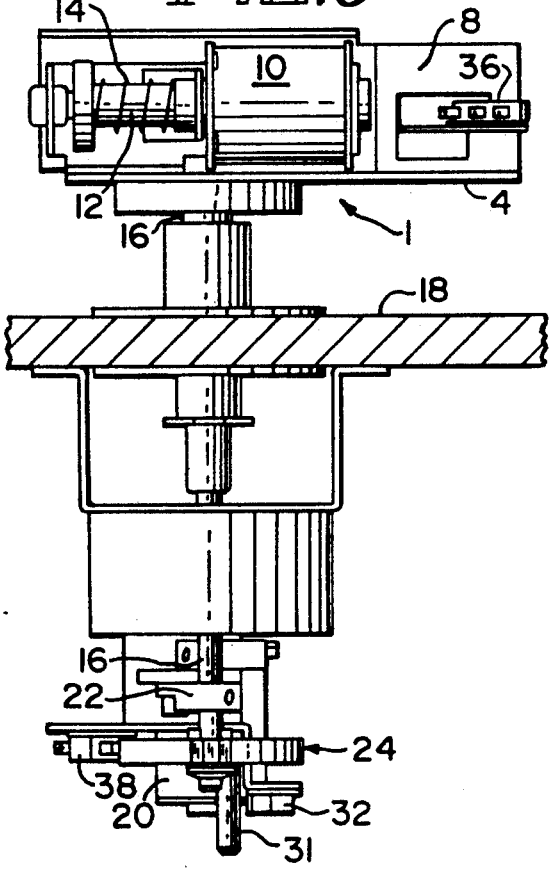
FIG. 5 is a side view of the play feature of the invention taken along line 5—5 of FIG. 3.

Referring more particularly to the Figures, the play feature of the invention consists of a projecting mechanism 1 having a ball receiving chute 2 defined by bottom wall 4 and sidewalls 6 and 8. An electronically actuated solenoid 10 is mounted on bottom wall 4 such that its plunger 12 extends parallel thereto. When solenoid 10 is actuated plunger 12 will extend into chute 2 (as shown by dotted lines in FIG. 2) to project a ball located therein from the device. A spring 14 returns plunger 12 to its retracted position shown in solid lines in FIGS. 2 and 5.

Bottom wall 4 is fixed to a shaft 16 mounted perpendicular to playfield 18 for rotary motion relative thereto. An electric motor 20 is operatively connected to shaft 16 via a reversing linkage system 22 such that actuation of motor 20 results in the oscillating movement of shaft 16 and projecting mechanism 1. A suitable gear reducer (not shown) can be used between motor 16 and linkage system 22 to control the speed of shaft 16 if so desired.

Fixed to the distal end of shaft 16 is a camming member 24 having a cam surface 27 formed in its periphery. Camming member 24 also supports a cam pin 31. When shaft 16 is rotated by motor 20, camming member 24 is also rotated such that the position of cam surface 27 and cam pin 31 are changed.

A first switch 32, the home switch, determines whether or not projecting mechanism 1 is in its home position by detecting the presence or absence of cam pin 31. The home position is defined as the position where chute 2 can receive a ball. The projecting mechanism 1 is shown in its home position in a preferred embodiment in FIG. 1 where chute 2 is aligned with ramp 34 such that if the player directs a pinball into ramp 34 it will be delivered to chute 2. It is to be appreciated that any suitable method of delivering a ball to the chute 2, such as a ball popper, can be used in place of ramp 34.

A second switch 36 is located in chute 2 to indicate the presence or absence of a pinball therein. When a pinball is detected by switch 36 a signal is delivered to the game's microprocessor to initiate the play feature of the invention as will hereinafter by described.

A third switch 38, the arming switch, is mounted such that the switch lever 40 contacts the periphery of camming member 24. As a result, when lever 40 follows cam surface 27 the arming switch 38 will be opened and a signal will be delivered to the game's microprocessor to arm the projecting mechanism, as will hereinafter be described.

Activation of solenoid 10 is accomplished by the player by pressing a button located on the game's housing once the projecting member has been armed. In a preferred embodiment one of the flipper buttons 42 (FIG. 1) is used to activate the solenoid; however, a separate button can be provided if so desired.

Figure 1:
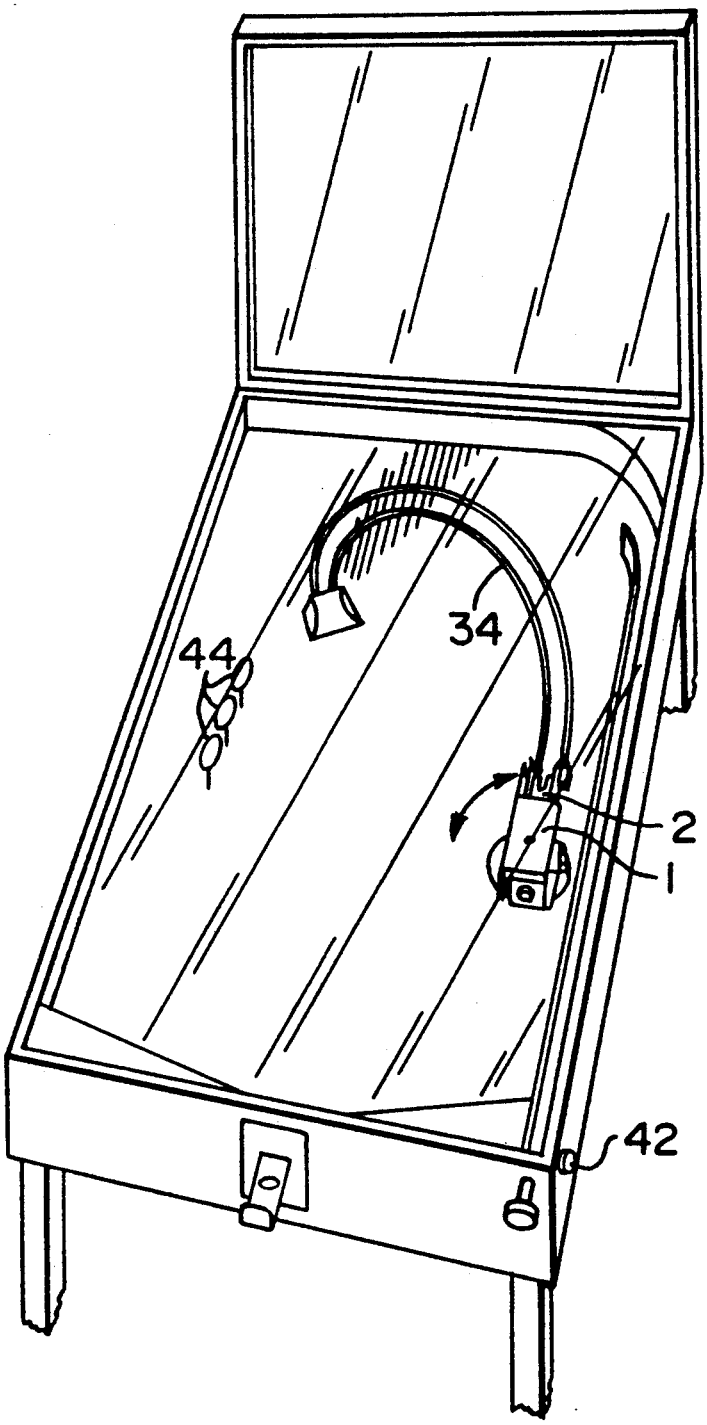
FIG. 1 is a perspective view of the play feature of the invention mounted on a pinball game.

In a preferred embodiment, the projecting member 2 will be located in spaced relationship to a plurality of targets 44, see FIG. 1, such that skillful firing of the projecting mechanism will provide various scoring and play opportunities for the player. As will be evident, a wide variety of play features can be used in conjunction with the play feature of the invention to vary the targets presented to the player.

Figure 4:
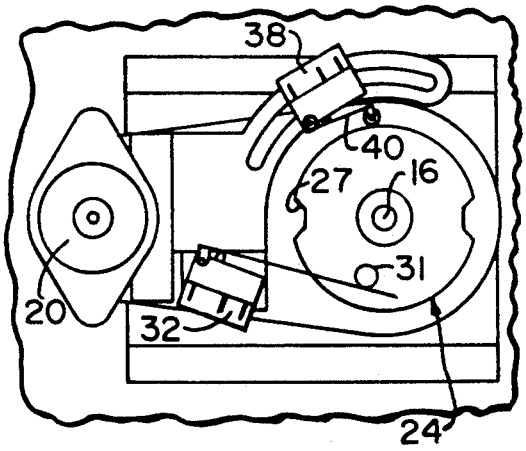
FIG. 4 is a bottom view of the play feature of the invention taken along line 4—4 of FIG. 3.
Figure 3:
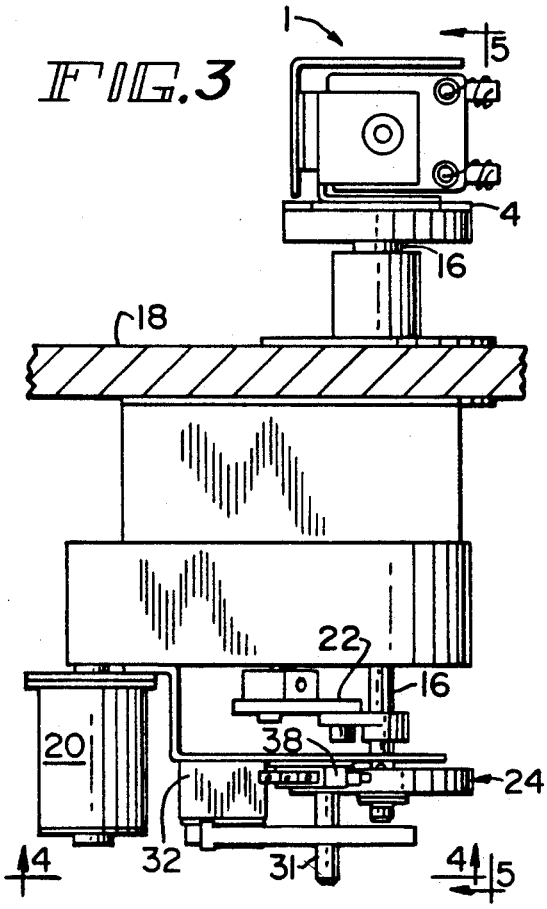
FIG. 3 is a front view of the play feature of the invention taken along line 3—3 of FIG. 2.

The operation of the play feature of the invention will now be described. When the game begins the projecting mechanism is in the have position shown in FIG. 1 with chute 2 in position to receive a ball. Home switch 32 is closed as shown in FIG. 4 and motor 20 is inactivated. When a ball enters chute 2, switch 36 will be closed which signals the microprocessor to activate motor 20. Activation of motor 20 simultaneously rotates the camming member 24 and the projecting mechanism 1. These members will rotate approximately 60° before switch 38 is opened as switch lever 40 engages can surface 26. The opening of switch 38 arms the projecting mechanism 1 such that the player can activate solenoid 10 by pressing button 42 to project the ball at the desired target. During the 60° of rotation prior to switch 38 being opened, the solenoid 10 is deactivated and cannot be fired.

After rotating another 30° (for a total of 90° of rotation, including the initial disarmed 60°), the linkage system 22 will reverse the rotation of shaft 16 such that the projecting mechanism 1 will rotate back toward its home position. After traveling 30° toward the home position switch 38 will be closed by contact with cam surface 26 and the solenoid 10 will be disarmed such that the player cannot fire the projecting means. Thus, the player has two 30° passes to fire the ball at the targets. If the player does not fire the ball during the armed portion of the projecting mechanism's movement, the game microprocessor is programmed to activate solenoid 10 and fire the ball on its own. The empty projecting mechanism 1 continues to rotate back to the home position until home switch 32 is closed and the device is deactivated. The device will remain deactivated until a ball once again enters chute 2 and closes switch 36.

Figure 6:
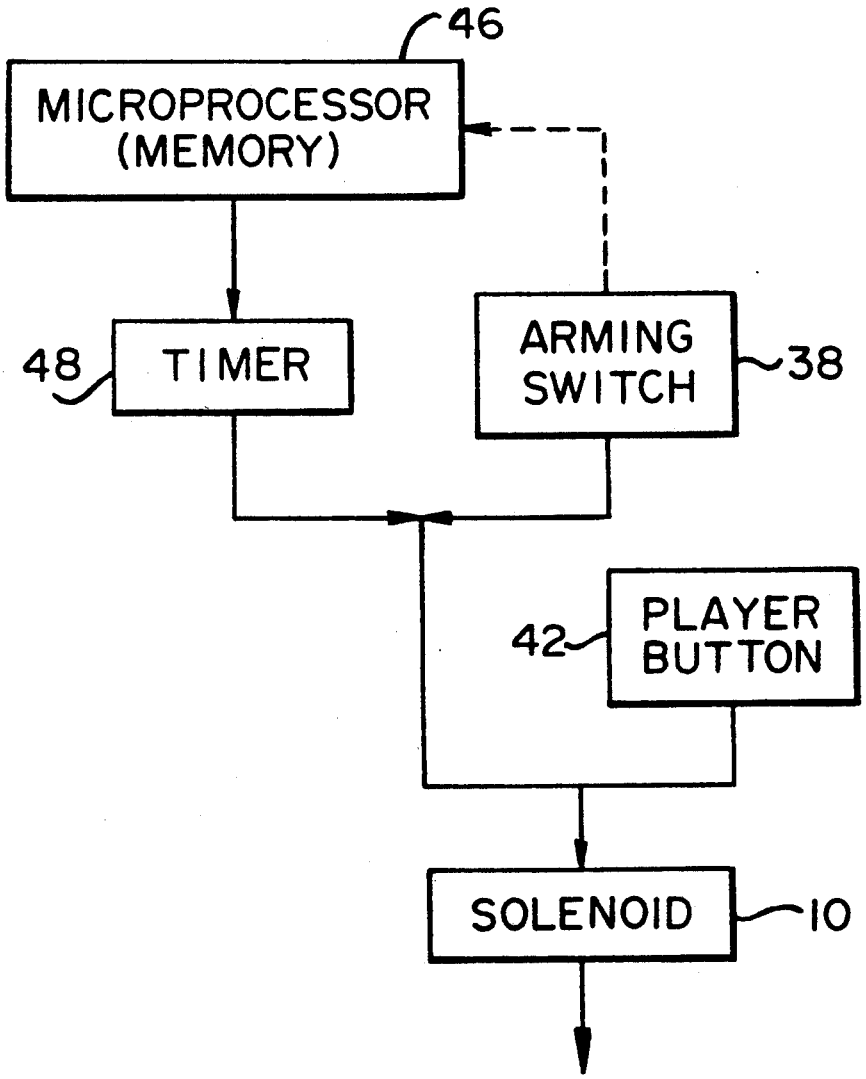
FIG. 6 is a block diagram of the control system for the play feature of the invention.

In the event that arming switch 38 fails, a back-up arming system is employed as best shown in FIG. 6. The microprocessor 46 is programmed to monitor the arming switch 38 such that if the arming switch fails, the microprocessor will automatically go to the back-up system. The microprocessor 46 senses the average time for a cycle of the arming and disarming of solenoid 10 to occur and determines and stores an average time for the cycle. Specifically, the microprocessor stores the times for the last seven cycles that the arming switch worked properly such that the average time is continuously updated. If the arming switch 38 fails, a timer activates the arming and disarming of the solenoid 10 based on the average times stored in the microprocessor. Thus, the arming switch 38 is replaced by a timing circuit to ensure that the solenoid will be armed only during the range of motion that it would have been activated had the arming switch been working properly.

While the invention has been described in detail with particular reference to the Figures, it is to be understood that this disclosure was made by way of example only and that the within is to be limited only by the appended claims.

What is claimed is:

1. A play feature for a pinball game having an inclined play field supporting a rolling ball, comprising:

a) means for receiving a ball during the course of game play;

b) means for rotating said means for receiving a ball relative to the play field; and c) means for projecting the ball from the means for receiving a ball while said means for receiving a ball is being rotated by said means for rotating and means for arming said means for projecting the ball only during a portion of its rotation.

2. The play feature according to claim 1, wherein said means for projecting is controlled by a player operated button.

3. The play feature according to claim 2, wherein said player operated button is a flipper switch.

4. The play feature according to claim 1, wherein said means for arming includes a switch engageable with a camming means mounted for rotation with said means of receiving a ball.

5. The play feature according to claim 1, wherein said means for arming includes a timer.

6. The play feature according to claim 1, further including means for determining if said means for receiving a ball is in position to receive a ball.

7. The play feature according to claim 1, further including means for determining if a ball is present in said means for receiving a ball and for actuating said means for rotating when a ball is present.

8. The play feature according to claim 1, wherein said means for rotating includes a motor and a reversing linkage system.

9. The play feature according to claim 1, wherein said means for projecting includes a solenoid.

10. A play feature for a pinball game having an inclined play field supporting a rolling ball, comprising:

a) means for receiving a ball during the course of game play;

b) means for generating a signal indicating that a ball has entered the means for receiving;

c) means for automatically rotating said means for receiving a ball relative to the play field upon receipt of said signal, the angular position of the ball relative to the play field being changed as the means for receiving is rotated;

d) player controlled means for linearly projecting the ball from the means for receiving a ball while said means for receiving a ball is being rotated by said means for rotating; and e) means for automatically projecting the ball from the means for receiving a ball if the player controlled means is not activated a predetermined time after the signal is generated.

11. The play feature according to claim 10, wherein the means for receiving is rotated in a first direction for a predetermined distance and is rotated in a second direction opposite the first direction for a predetermined distance.

12. The play feature according to claim 10, wherein the means for automatically rotating includes a microprocessor that activates a drive means upon receipt of said signal.

13. A play feature for a pinball game having an inclined play field supporting a rolling ball, comprising:

a) means for receiving a ball during the course of game play;

b) means for generating a signal indicating that a ball has entered the means for receiving;

c) means for automatically rotating that means for receiving a ball relative to the play field upon receipt of said signal, the angular position of the ball relative to the play field being changed as the means for receiving is rotated;

d) player controlled means for linearly projecting the ball from the means for receiving a ball while said means for receiving a ball is being rotated by said means for rotating; and e) means for automatically projecting the ball from the means for receiving a ball after the means for receiving a ball has been rotated through a predetermined angle.

* * * * *